US011920782B2

(12) United States Patent
Nasman et al.

(10) Patent No.: US 11,920,782 B2
(45) Date of Patent: Mar. 5, 2024

(54) STREAMLINED VAPORIZER CORES

(71) Applicant: Tokyo Electron Limited, Tokyo (JP)

(72) Inventors: Ronald Nasman, Albany, NY (US); Daniel Newman, Albany, NY (US)

(73) Assignee: Tokyo Electron Limited, Tokyo (JP)

( * ) Notice: Subject to any disclaimer, the term of this patent is extended or adjusted under 35 U.S.C. 154(b) by 757 days.

(21) Appl. No.: 17/090,075

(22) Filed: Nov. 5, 2020

(65) Prior Publication Data

US 2021/0148564 A1 May 20, 2021

Related U.S. Application Data

(60) Provisional application No. 62/963,896, filed on Jan. 21, 2020, provisional application No. 62/936,938, filed on Nov. 18, 2019.

(51) Int. Cl.
*F22B 1/28* (2006.01)

(52) U.S. Cl.
CPC ..... *F22B 1/282* (2013.01)

(58) Field of Classification Search
None
See application file for complete search history.

(56) References Cited

U.S. PATENT DOCUMENTS 5,190,060 A * 3/1993 Gerding ..... A24D 1/22 131/194
5,711,816 A 1/1998 Kirlin et al.
11,109,622 B1 * 9/2021 Woodbine ..... A24F 40/46
2006/0051275 A1 * 3/2006 Ramani ..... C01B 17/0465 422/600
2012/0199335 A1 8/2012 Maurer
2013/0284169 A1 * 10/2013 Foote ..... H05B 3/42 128/203.14

(Continued)

FOREIGN PATENT DOCUMENTS

KR 1020100067936 A 6/2010
KR 1020140033987 A 3/2014

OTHER PUBLICATIONS

Korean Intellectual Property Office, The International Search Report and Written Opinion for International Application No. PCT/US2020/059049, dated Feb. 26, 2021, 12 pages.

*Primary Examiner* — Thor S Campbell

(57) ABSTRACT

Vaporizer cores are disclosed including a housing and a chamber where the chamber includes a porous lattice structure that is thermally conductive. Further, the housing and the chamber including the porous lattice structure are formed as a single integral structure. Three-dimensional (3D) printing can be used to form the housing and the chamber including the porous lattice structure as a single integral structure. For certain embodiments, a concentric-circle fin design, a crisscross fin design, or a conical fin design is used to form the porous lattice structure for the vaporizer chamber. For further embodiments, techniques are implemented to resolve potential problems with 3D printing of the vaporizer cores. One example technique is encapsulation of the vaporizer core within a shell, such as a two-piece shell, to resolve potential problems with leaks. Disclosed embodiments for the vaporizer cores provide manufacturing, material, and design improvements to prior solutions.

18 Claims, 5 Drawing Sheets

(56) References Cited

U.S. PATENT DOCUMENTS

| | | | | |
|---|---|---|---|---|
| 2015/0101606 | A1* | 4/2015 | White | A61M 15/00 131/194 |
| 2015/0209530 | A1* | 7/2015 | White | A24D 1/20 128/200.23 |
| 2018/0066363 | A1* | 3/2018 | Nasman | C23C 16/4405 |
| 2019/0387797 | A1* | 12/2019 | Christensen | H05B 3/44 |

* cited by examiner

STREAMLINED VAPORIZER CORES

RELATED APPLICATIONS

This application claims priority to the following applications: U.S. Provisional Patent Application Ser. No. 62/936,938, filed Nov. 18, 2019, and entitled "STREAMLINED VAPORIZER CORES," and U.S. Provisional Patent Application Ser. No. 62/963,896, filed Jan. 21, 2020, and entitled "STREAMLINED VAPORIZER CORES," which are hereby incorporated by reference in their entirety.

BACKGROUND

The present disclosure relates to systems and methods for the manufacture of microelectronic workpieces.

Device formation within microelectronic workpieces typically involves a series of manufacturing techniques related to the formation, patterning, and removal of a number of layers of material on a substrate. Vaporizers are used in certain processing equipment for the manufacture of microelectronic workpieces. Vaporizers receive a liquid solution as an input, vaporize the solution within a vaporizer core, and output a vaporized liquid. This vaporized liquid can be used within a process chamber to perform various processes with respect to microelectronic workpieces being processed within the processing equipment. Prior solutions for vaporizers and vaporizer cores are described, for example, in U.S. Pat. No. 9,523,151 and U.S. Published Patent Application No. 2018-0066363, each of which is hereby incorporated by reference in its entirety.

FIG. 1 (Prior Art) is a cross-section diagram of an example embodiment of a prior solution for a vaporizer 100 where a nozzle assembly 125 is used as described in U.S. 2018-0066363. The nozzle assembly 125 is included within the metal flange 110, which is coupled to the larger metal flange 122 using bolts 126. The metal flange 122 is in turn coupled to the top metal flange 154 for the vaporizer core 155 using bolts 128. The mounting bracket 124 is also coupled to the metal flange 122 using the bolts 128. The liquid to be vaporized enters the nozzle assembly 125 through a gland 102. The carrier gas channel 120 receives the carrier gas from a gas source line 152, and premixed liquid from the premix chamber within the nozzle assembly 125 is introduced into the vaporizer chamber 156 for the vaporizer core 155. The vaporizer chamber 156 can include additional material, such as aluminum foam, that further facilitates vaporization, and heaters can be applied to further facilitate vaporization and inhibit condensation. A bottom metal flange 158 for the vaporizer core 155 is coupled to an outlet metal flange 160 using bolts 162 to provide a metal seal at the bottom of the vaporizer core 155. The resulting vaporized gas including the vaporized solution and carrier gas leaves the vaporizer chamber 156 through the gas outlet channel 164. The vaporized gas is then provided through a gas line 166 to other processing tools, for example, where the vaporized gas can be used to deposit one or more layers on a substrate within a deposition chamber for a substrate processing system.

It is noted that the orientation, length, and other configuration for the gas outlet channel 164 and related gas line 166 can be adjusted as desired. For example, rather than extending laterally as shown, the gas outlet channel 164 may be oriented such that it extends vertically towards a deposition chamber located below the vaporizer core 155. In addition, the gas outlet 164 and gas line 166 can extend to one or more additional processing tools located at various distances from the vaporizer. While these distances are preferably short, the distances can include distances of up to 15 feet or more depending upon the chemistry and processes involved. Although not shown, it is also noted that heaters can be positioned around the perimeter of each component within the vaporizer, including the vaporizer core 155, to facilitate vaporization and to inhibit or prevent condensation. Further, heaters can also be positioned around the gas outlet 164 and gas line 166 to inhibit or prevent condensation. In addition, the housing for the vaporizer chamber 156 can be aluminum to facilitate heat transfer to aluminum foam within the vaporizer chamber 156. Further, the top metal flange 154 and the bottom metal flange 158 can be implemented using bimetal metal flanges including stainless steel sealing faces explosion welded to an aluminum body, which are available from Atlas Technologies. The aluminum bodies for these bimetal metal flanges then allow for better heat transfer to the aluminum housing for the vaporizer chamber 156 in such embodiments. Other variations can also be implemented.

It is noted that the overall operation and implementation of the vaporizer in FIG. 1 (Prior Art) is described within U.S. Pat. No. 9,523,151 and U.S. Published Patent Application No. 2018-0066363. For example, as described in U.S. Pat. No. 9,523,151 open cell aluminum foam can be used within the vaporizer chamber 156. This foam can be vacuum brazed to a heated aluminum housing for the vaporizer chamber 156 thereby providing excellent thermal communication between the aluminum foam and the aluminum wall of the vaporizer chamber 156. An aluminum braze can also be used instead of a more volatile braze material that may contaminate the chemistry of the overall process. In effect, the open cell aluminum foam greatly diminishes the distance from the heated wall of the vaporizer chamber 156 to the evaporating droplets passing through the vaporizer chamber 156.

In operation, as the droplets evaporate within the vaporizer chamber 156, their temperature can decrease considerably. For certain embodiments, additional energy is provided through heaters to maintain the evaporation process and rate. Because the vaporizing environment is a vacuum, thermal conduction to the heated wall through the gas is limited. As such, prior vaporizers that have open vaporization chambers typically operate at temperature much higher than optimal in order to create a temperature gradient high enough to overcome the thermal resistance of the rarified gas within the open vaporization chamber. For such open chamber systems, droplets that fail to fully vaporize and travel through the chamber intact can land on the surface of the wall, which in its overheated state not only induces flash vaporization but also induces potential chemical breakdown. This chemical breakdown can produce deposits, particles, and other unwanted byproducts within the system. However, if a lower temperature is employed in such open chamber systems, non-vaporized droplets can pool, and these pooled chemicals can potentially affect the stability of supply lines to the process chamber and/or chemically break down thereby adversely impacting the system. The utilization of heated aluminum foam within the vaporizer chamber 156 as described in U.S. Pat. No. 9,523,151, however, reduces the thermal resistance between the droplets and the heated wall by reducing the distance between them. This reduction in thermal resistance permits the use of a much lower operating temperature for the vaporizer, encouraging vaporization without direct wall contact.

Additional improvements to vaporizers and vaporizer cores are still desirable in addition to the advantages of the vaporizer embodiments described in U.S. Pat. No. 9,523,151 and U.S. Published Patent Application No. 2018-0066363.

SUMMARY

Embodiments are disclosed herein that provide manufacturing, material, and design improvements to prior solutions for vaporizers and vaporizer cores. For one embodiment, a vaporizer core includes a housing and a chamber. The chamber includes a thermally-conductive porous lattice structure, and the housing and chamber including the porous lattice structure are formed as a single integral structure. Further, three-dimensional (3D) printing can be used to form the vaporizer core a single integral structure. For further embodiments, a concentric-circle fin design, a crisscross fin design, and/or a conical fin design is used to form the porous lattice structure for the vaporizer chamber. For further embodiments, techniques are implemented to resolve problems with 3D printing of the vaporizer cores. One example technique is encapsulation of the vaporizer core within a shell, such as a two-piece shell. Different or additional features, variations, and embodiments can also be implemented, and related systems and methods can be utilized as well.

For one embodiment, a vaporizer core is disclosed including a housing and a chamber within the housing, and the chamber includes a porous lattice structure that is thermally conductive. Further, the housing and the chamber including the porous lattice structure are formed as a single integral structure.

In additional embodiments, the housing and the chamber including the porous lattice structure are formed by three-dimensional (3D) printing. In further embodiments, the vaporizer core also includes a shell that is thermally conductive, and the housing and the chamber including the porous lattice structure are encapsulated in the shell. In further embodiments, the shell includes a top portion and a bottom portion welded together along a central seam. In still further embodiments, the shell is melted to the housing at a plurality of locations.

In additional embodiments, one or more of sintered metal, nano wires, metal fibers, or fibers made from a thermally conductive material are used to form the housing, the chamber, or both the housing and the chamber. In further additional embodiments, the housing and the chamber including the porous lattice structure are stainless steel.

In additional embodiments, the chamber includes a first stage for the vaporizer core, and the vaporizer core further includes a second stage coupled to the first stage within the housing. In further embodiments, the housing and the chamber including the porous lattice structure are formed by three-dimensional (3D) printing, and the second stage is not formed by 3D printing.

In additional embodiments, the chamber includes a plurality of fins. In further embodiments, the chamber includes at least one of a concentric-circle fin design, a crisscrossed fin design, or a conical fin design to form the porous lattice structure. In still further embodiments, the plurality of fins are solid fins.

In additional embodiments, the chamber includes a porous metal structure to form the porous lattice structure. In further embodiments, the porous metal structure includes a metal foam or a metal fiber mesh.

In additional embodiments, the chamber includes an expanding cone shape to receive an atomized liquid and an expanding cone shape to output a vaporized liquid. In further additional embodiments, surfaces of the housing and the chamber are polished.

For one embodiment, a vaporizer is disclosed including a nozzle assembly coupled to receive a liquid and a carrier gas, a vaporizer core, and a gas outlet channel. The vaporizer core includes a housing coupled to the nozzle assembly to receive the liquid and the carrier gas and a chamber within the housing. The chamber includes a porous lattice structure that is thermally conductive, and the housing and the chamber including the porous lattice structure are formed as a single integral structure. The gas outlet channel is coupled to receive a vaporized gas from the vaporizer core including the vaporized liquid and the carrier gas.

In additional embodiments, the housing and the chamber including the porous lattice structure are formed by three-dimensional (3D) printing. In further embodiments, the vaporizer core further includes a shell that is thermally conductive, and the housing and the chamber including the porous lattice structure are encapsulated in the shell.

In additional embodiments, the chamber includes a plurality of fins including at least one of a concentric-circle fin design, a crisscrossed fin design, or a conical fin design to form the porous lattice structure.

Different or additional features, variations, and embodiments can also be implemented, and related systems and methods can be utilized as well.

BRIEF DESCRIPTION OF THE DRAWINGS

A more complete understanding of the present inventions and advantages thereof may be acquired by referring to the following description taken in conjunction with the accompanying drawings, in which like reference numbers indicate like features. It is to be noted, however, that the accompanying drawings illustrate only exemplary embodiments of the disclosed concepts and are therefore not to be considered limiting of the scope, for the disclosed concepts may admit to other equally effective embodiments.

DETAILED DESCRIPTION

The disclosed embodiments provide improved vaporizers and vaporizer cores that can be used in processing equipment for the manufacture of microelectronic workpieces. A variety of advantages and implementations can be achieved while taking advantage of the techniques described herein.

Figure 1:
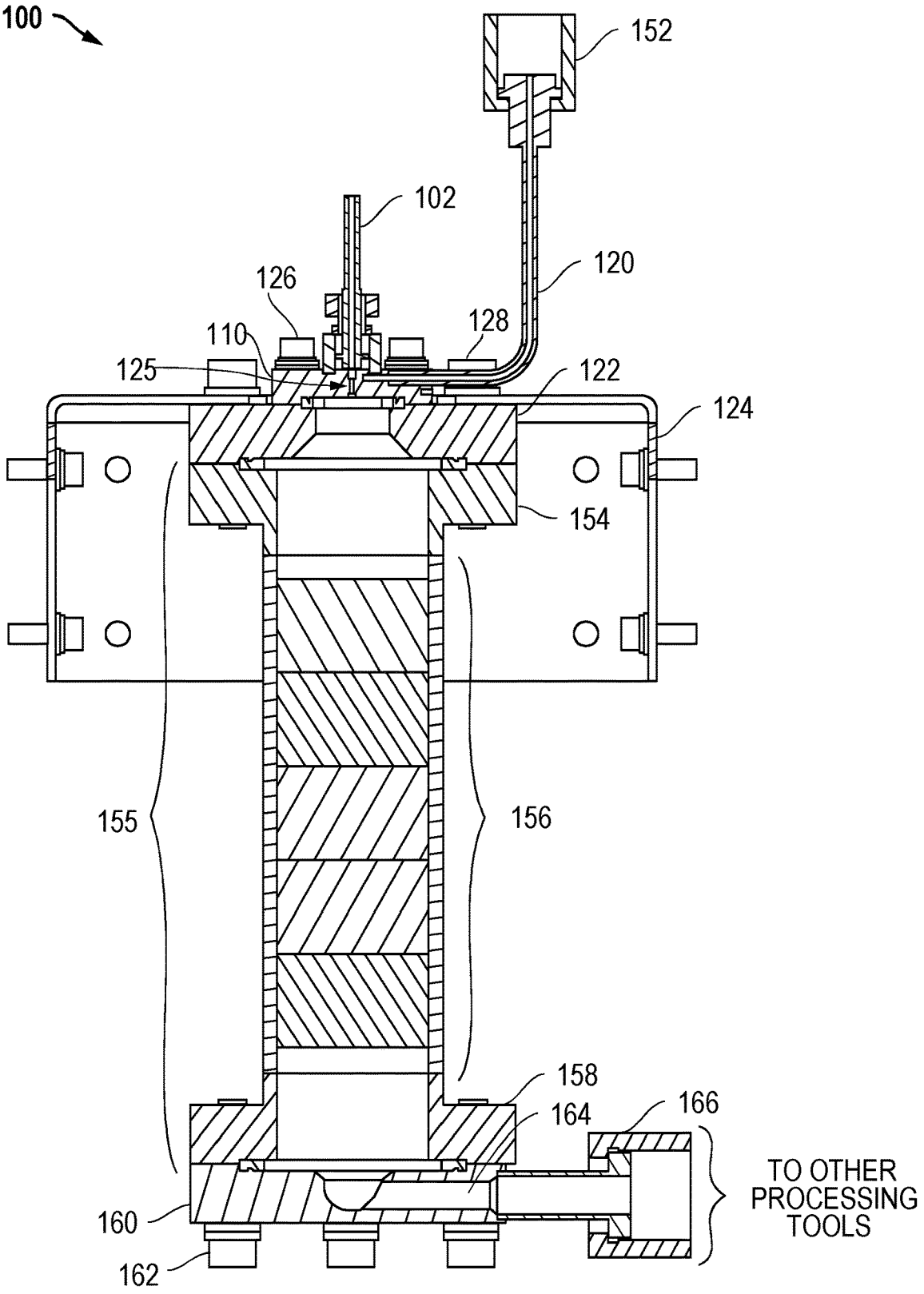
FIG. 1 (Prior Art)
FIG. 1 (Prior Art) is a cross-section diagram of an example embodiment for a prior vaporizer and vaporizer core solution.

As described herein, vaporizer cores are formed as a single integral structure including a housing and a chamber within the housing where the chamber includes a porous lattice structure that is thermally conductive. In contrast, prior solutions such as those described above with respect to FIG. 1 (Prior Art) used metal foams, such as aluminum foams, as a separate component that is pressed into a separately formed vaporizer housing. In part, therefore, the disclosed embodiments provide manufacturing, material, and design improvements to the prior vaporizers described in U.S. Pat. No. 9,523,151 and U.S. Published Patent Application No. 2018-0066363, each of which is hereby incorporated by reference in its entirety.

As described herein, the porous lattice structures for the vaporizer chambers described herein can implemented using a variety of techniques. For example, the porous lattice structure can be a metal foam, a metal fiber mesh, or other porous metal structure that is formed integrally with a vaporizer housing to form a single integral structure. For one embodiment, the porous metal structure is formed by three-dimensional (3D) printing. In addition to 3D printing, the porous metal structure for the vaporizer chamber can also be formed using sintered metal, nano wires, metal fibers, or fibers made from a thermally conductive material. Further, metals such as aluminum, stainless steel (e.g., 304 stainless steel, 316 stainless steel, or other stainless steel alloys), or other metals or thermally conductive materials can be used. These new integral structures provide a thermally-conductive porous lattice structure that provides similar advantages for the vaporizer core as provided by the separate metal foams in the prior solutions while reducing manufacturing cost and complexity. Other advantages can also be achieved.

FIGS. 2A-2C and FIGS. 3A-3C provide example embodiments for porous lattice structures that can be used for the vaporizer chambers formed integrally within vaporizer housings. The vaporizer housings and the vaporizer chambers including the porous lattice structures are thermally conductive. For these example embodiments, atomized liquid enters at the top of the vaporizer chamber, and vaporized liquid, as well as a carrier gas if used, comes out from the bottom of the vaporizer chamber. An expanding cone shape is used to receive the atomized liquid at the top of the vaporizer chamber, and a smaller expanding cone shape is used to output the vaporized liquid at the bottom of the vaporizer chamber. It is noted that other shapes and lattice structures can also be implemented while still taking advantage of the embodiments described herein.

Figure 2A:
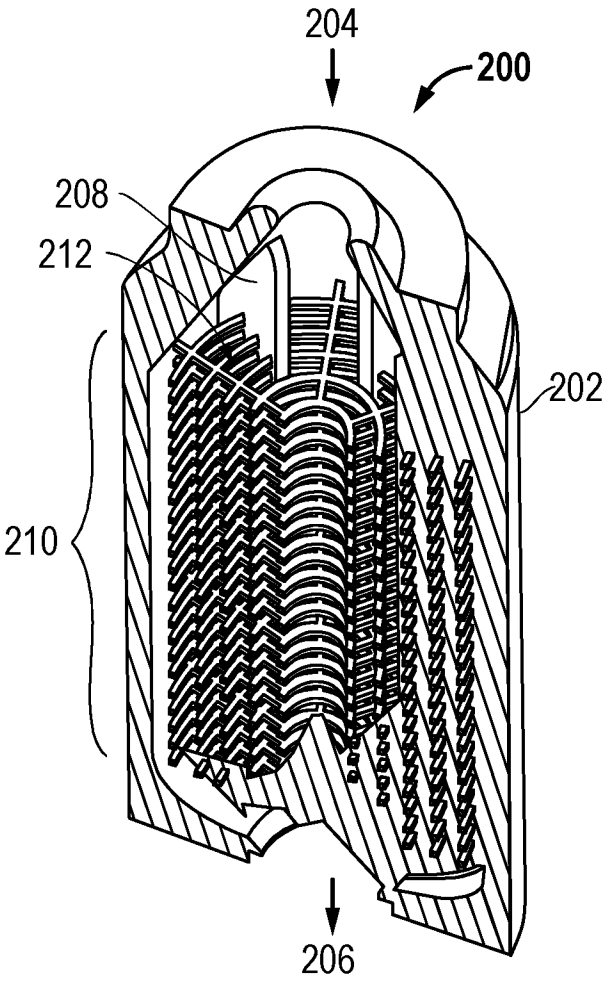
FIG. 2A is a cross-section perspective view of an example embodiment for a vaporizer core having a housing and a chamber where the chamber includes a plurality of fins and layers of concentric circles to form a porous lattice structure.

FIG. 2A is a cross-section perspective view of an example embodiment 200 for a vaporizer core having a housing 202 and a chamber 212 where the chamber 212 includes a plurality of fins 208 and layers of concentric circles 210 to form a porous lattice structure. This concentric-circle fin design has no direct path for liquid or gas to flow through the vaporizer chamber. For one embodiment, six fins 208 are used, and the fins 208 are solid fins. It is noted that additional or fewer fins could also be used and other variations could be implemented as well.

During operation, atomized liquid enters at the top of the vaporizer chamber 212 as indicated by arrow 204, and vaporized liquid comes out from the bottom of the vaporizer chamber 212 as indicated by arrow 206. An expanding cone shape is used to receive the atomized liquid at the top of the vaporizer chamber, and a smaller expanding cone shape is used to output the vaporized liquid at the bottom of the vaporizer chamber. It is noted that other shapes and lattice structures can also be implemented while still taking advantage of the embodiments described herein.

Figure 2B:
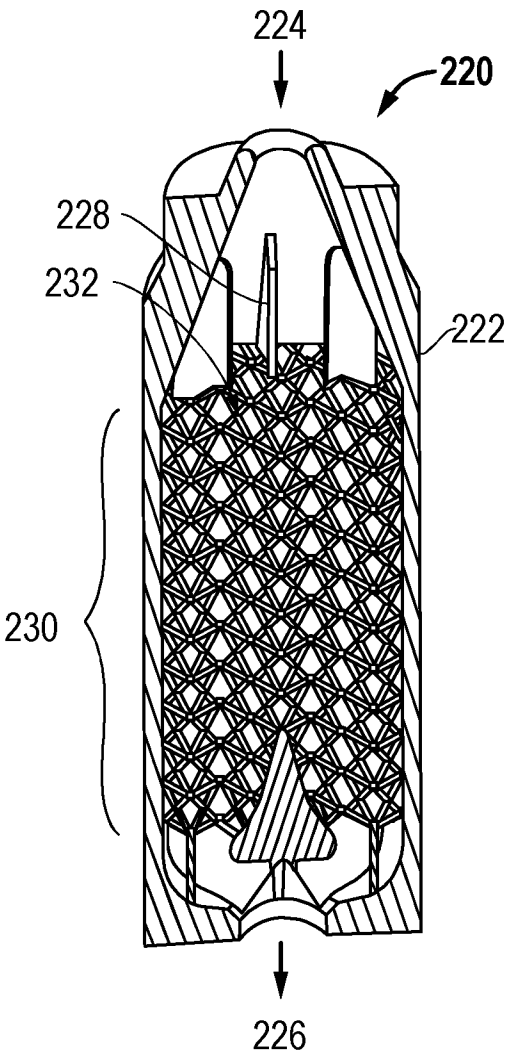
FIG. 2B is a cross-section perspective view of an example embodiment for a vaporizer core having a housing and a chamber where the chamber includes a plurality of fins and crisscrossed layers to form the porous lattice structure.

FIG. 2B is a cross-section perspective view of an example embodiment 220 for a vaporizer core having a housing 222 and a chamber 232 where the chamber 232 includes a plurality of fins 238 and crisscrossed layers 230 to form the porous lattice structure. This crisscrossed fin design also has no direct path for liquid or gas to flow through the vaporizer chamber. For one embodiment, six fins 228 are used, and the fins are solid fins. It is noted that additional or fewer fins could also be used and other variations could be implemented as well.

During operation, atomized liquid enters at the top of the vaporizer chamber 232 as indicated by arrow 224, and vaporized liquid comes out from the bottom of the vaporizer chamber 232 as indicated by arrow 226. An expanding cone shape is used to receive the atomized liquid at the top of the vaporizer chamber, and a smaller expanding cone shape is used to output the vaporized liquid at the bottom of the vaporizer chamber. It is noted that other shapes and lattice structures can also be implemented while still taking advantage of the embodiments described herein.

Figure 2C:
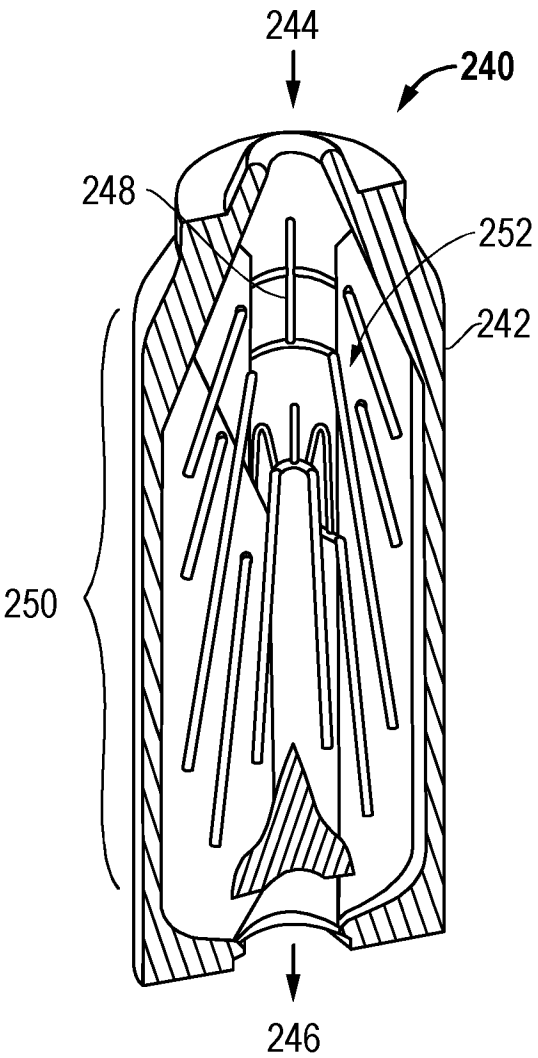
FIG. 2C is a cross-section perspective view of an example embodiment for a vaporizer core having a housing and a chamber where the chamber includes a plurality of cones to form the porous lattice structure.

FIG. 2C is a cross-section perspective view of an example embodiment 240 for a vaporizer core having a housing 242 and a chamber 252 where the chamber includes a plurality of cones 250 to form the porous lattice structure. This conical fin design includes a plurality of fins 248 and no direct path for liquid or gas to flow through the vaporizer chamber. For one embodiment, six fins 248 are used, and the fins are solid fins. It is noted that additional or fewer fins could also be used and other variations could be implemented as well.

During operation, atomized liquid enters at the top of the vaporizer chamber 252 as indicated by arrow 244, and vaporized liquid comes out from the bottom of the vaporizer chamber 252 as indicated by arrow 246. An expanding cone shape is used to receive the atomized liquid at the top of the vaporizer chamber, and a smaller expanding cone shape is used to output the vaporized liquid at the bottom of the vaporizer chamber. It is noted that other shapes and lattice structures can also be implemented while still taking advantage of the embodiments described herein.

Figure 3C:
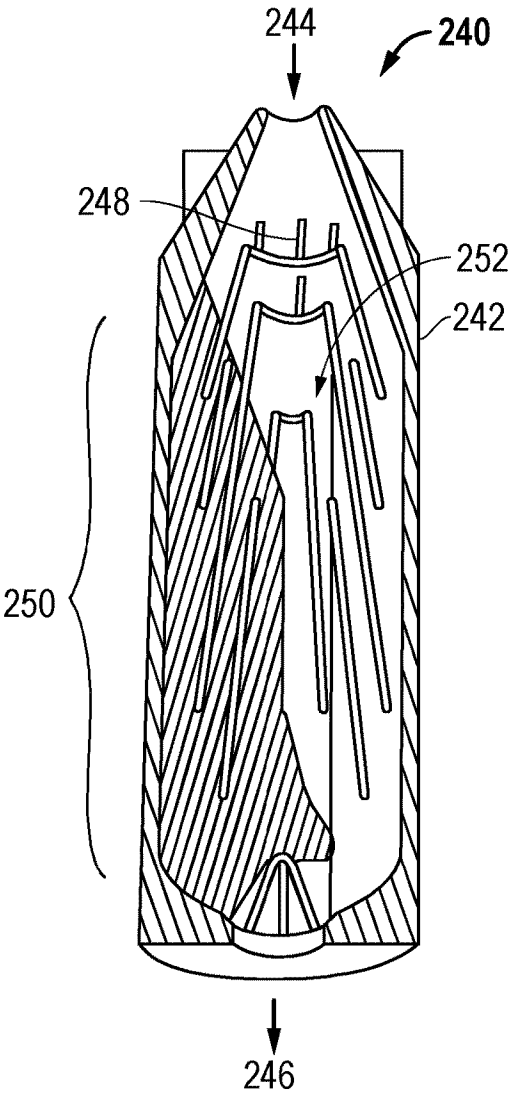
FIG. 3C is a cross-section view of the example embodiment shown in FIG. 2C for a conical fin design.
Figure 3B:
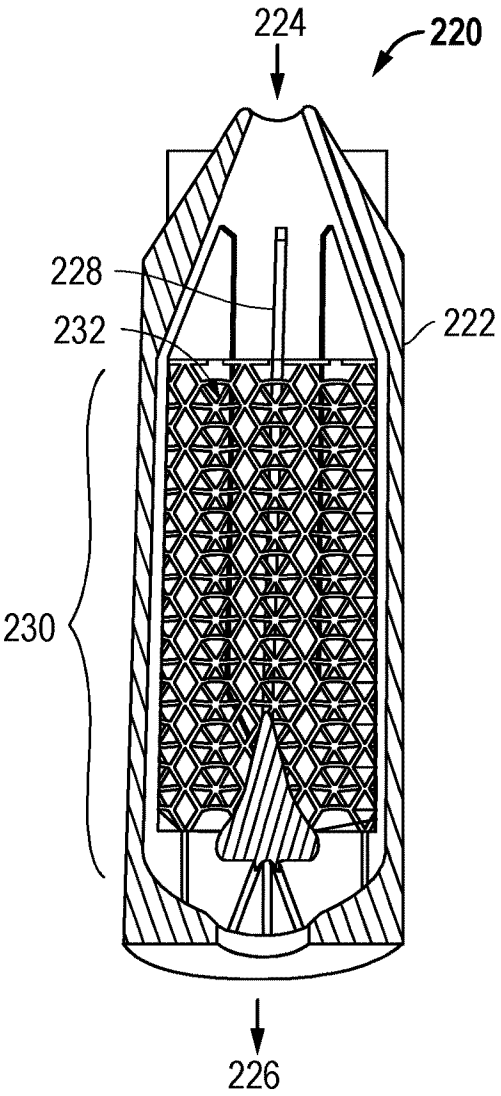
FIG. 3B is a cross-section view of the example embodiment shown in FIG. 2B for a crisscrossed fin design.
Figure 3A:
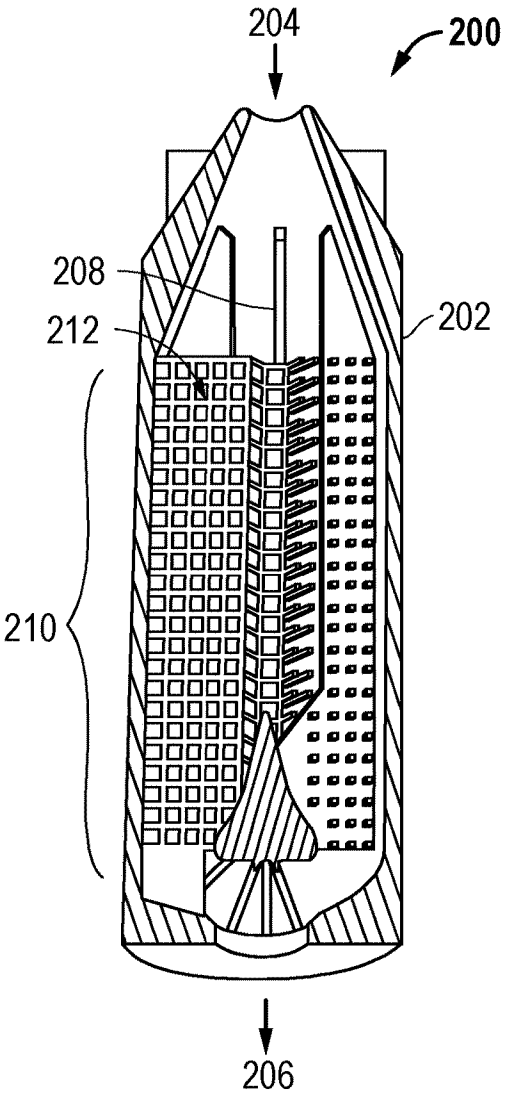
FIG. 3A is a cross-section view of the example embodiment shown in FIG. 2A for a concentric-circle fin design.

FIG. 3A is a cross-section view of the embodiment 200 shown in FIG. 2A for a concentric-circle fin design. This view in FIG. 3A shows the horizontal and vertical lattice structure formed by the concentric circles 210 within the vaporizer chamber 212. As described above, the vaporizer core for embodiment 200 includes a housing 202 and a chamber 212 where the chamber 212 includes a plurality of fins 208 and layers of interconnected concentric circles 210 to form a porous lattice structure. During operation, atomized liquid enters at the top of the vaporizer chamber 212 as indicated by arrow 204, and vaporized liquid comes out from the bottom of the vaporizer chamber 212 as indicated by arrow 206. As further indicated above, other shapes and lattice structures can also be implemented while still taking advantage of the embodiments described herein.

FIG. 3B is a cross-section view of the embodiment 220 shown in FIG. 2B for a crisscrossed fin design. This view in FIG. 3B shows the diagonal lattice structure formed by the crisscrossed layers within the vaporizer chamber 232. As described above, the vaporizer core for the embodiment 220 includes a housing 222 and a chamber 232 where the chamber includes a plurality of fins 228 and crisscrossed layers 230 to form the porous lattice structure. During operation, atomized liquid enters at the top of the vaporizer chamber 232 as indicated by arrow 224, and vaporized liquid comes out from the bottom of the vaporizer chamber 232 as indicated by arrow 226. As further indicated above, other shapes and lattice structures can also be implemented while still taking advantage of the embodiments described herein.

FIG. 3C is a cross-section view of the embodiment 240 shown in FIG. 2C for a conical fin design. This view in FIG. 3C shows the channelized lattice structure formed by the nested cones within the vaporizer chamber 252. As described above, the vaporizer core for embodiment 240 includes a housing 242 and a chamber 252 where the chamber 252 includes a plurality of fins 248 and a plurality of cones 250 to form the porous lattice structure. During operation, atomized liquid enters at the top of the vaporizer chamber 252 as indicated by arrow 244, and vaporized liquid comes out from the bottom of the vaporizer chamber 252 as indicated by arrow 246. As further indicated above, other shapes and lattice structures can also be implemented while still taking advantage of the embodiments described herein.

As indicated above, the vaporizer cores in FIGS. 2A-2C and FIGS. 3A-3C can be formed as a 3D-printed lattice structures for a vaporizer chamber integral with a vaporizer housing using one or more 3D printers and/or 3D printing techniques. Preferably, the vaporizer core is formed in a single-step 3D printing process to form a vaporizer chamber with a porous lattice structure within the vaporizer housing as a single integral structure. 3D printing of the vaporizer cores allows rapid changes to be made to the pore size within the lattice structure, part density, pattern, and/or other features for the vaporizer cores. It is also noted that multiple 3D printing steps could also be used to form the single integral structure. Other variations could also be implemented while still taking advantage of the structures and techniques described herein.

In addition to 3D printing, the thermally-conductive porous lattice structures can also be formed as a sintered metal mesh using sintering techniques and/or as a compilation of metal fibers using a pressing technique. Other techniques can also be used. For one embodiment, the vaporizer chambers include multiple stages, and each stage can be different. For one further example, a first stage is formed as a 3D-printed porous lattice structure (e.g., metal porous lattice structure), and a second stage is formed as a sintered metal mesh.

For one embodiment, the housing and chamber for the vaporizer core are formed entirely of stainless steel. Stainless steel allows compression of metal gaskets that provide high-temperature vacuum seals on either end of the vaporizer core. While the thermal conductance of stainless steel is much less than aluminum, the metal radial fins within the vaporizer chambers provide a direct conductive path to cool the chamber. Further, the outer diameter for the vaporizer core can be decreased to further reduce thermal resistance.

It is noted that where stainless steel metal seals are used for high temperature environments, flanges adjacent these seals are required to be made of stainless steel so that the materials match. One previous design utilized an aluminum foam within the vaporizer core that required a transition from the stainless steel flange to the aluminum core. One option for this transition is bimetal flanges that have a seal side made of stainless steel explosion bonded/welded to a second side made of aluminum. To improve the bonding between steel and aluminum surfaces, thin layers of other metals, some of which contained copper, are often used for such bimetal flanges. When exposed to the flow path, however, the resulting seam can allow copper to be introduced to the process environment, which is a highly undesirable result for some process steps.

To avoid this result, another option is to use aluminum flanges and aluminum O-rings to provide the seal. Although this all aluminum solution can be implemented in production, it adds significant additional costs.

One additional solution is to have stainless steel flanges connected with a stainless steel tube. An aluminum foam is then pressed and brazed inside a smaller aluminum tube which in turn is press fit with a thermal interference inside the stainless tube. While this is an effective approach, it also adds additional cost. Further, undesirable thermal resistance is caused by the press fit between the stainless steel and aluminum tubes residing in the vacuum environment. Actual mechanical contact between such surfaces can be below 10% with gas trapped between the surfaces providing most of the heat transfer. In a vacuum environment, however, the heat transfer provided by this interstitial gas is greatly reduced.

For the disclosed embodiments, it is preferred that a stainless steel material is used throughout the vaporizer core. While stainless steel has a much lower thermal conductivity than aluminum, design features can compensate for this reduction. For example, one or more of the following can be used: (1) smaller diameter cores that reduce conduction distance, (2) relatively thick and straight fins including solid fins that conduct heat directly to the center of the core (as opposed to foam that provides a narrow path), (3) thicker printed lattice structures that reduce conduction path lengths, and/or (4) other design features or combinations of features.

Where 3D printing is used to form the metal lattice structure for the vaporizer cores described herein, the resulting vaporizer cores can also be further processed to improve the vaporizer. For example, the 3D-printed vaporizer core can be polished before being combined within the vaporizer. This polishing can be implemented, for example, using electro-polishing or chemical polishing. Further, the inside surfaces can also be polished by extrusion polishing where an abrasive paste is pushed through the inside of the vaporizer chamber. The outside surfaces can also be polished by machining, turning, or hand polishing the outside surfaces of the vaporizer housing. Other variations and techniques can also be implemented.

For one further example embodiment, additional techniques are applied to the 3D-printed vaporizer cores to resolve potential problems. For example, the vaporizer cores can be encapsulated in stainless steel or other thermally conductive material after being 3D printed to better seal the resulting structures. This encapsulation has been found to provide improved seals to stop vacuum or other leaks for 3D printed metals, some of which can have porosity or imperfections that cause leaks in vacuum environments. For example, where 3D printing of stainless steel is used for the vaporizer cores along with welding to stainless steel fittings, the welds can expose the porosity within the 3D-printed structures and cause leaks at the welds. Encapsulation of the vaporizer core in a shell resolves these problems and provides a leak free solution. The shell can be stainless steel or other metal material. Further, other thermally conductive material or coating could also be used for this shell, and a multiple piece shell can be used.

Figure 4:
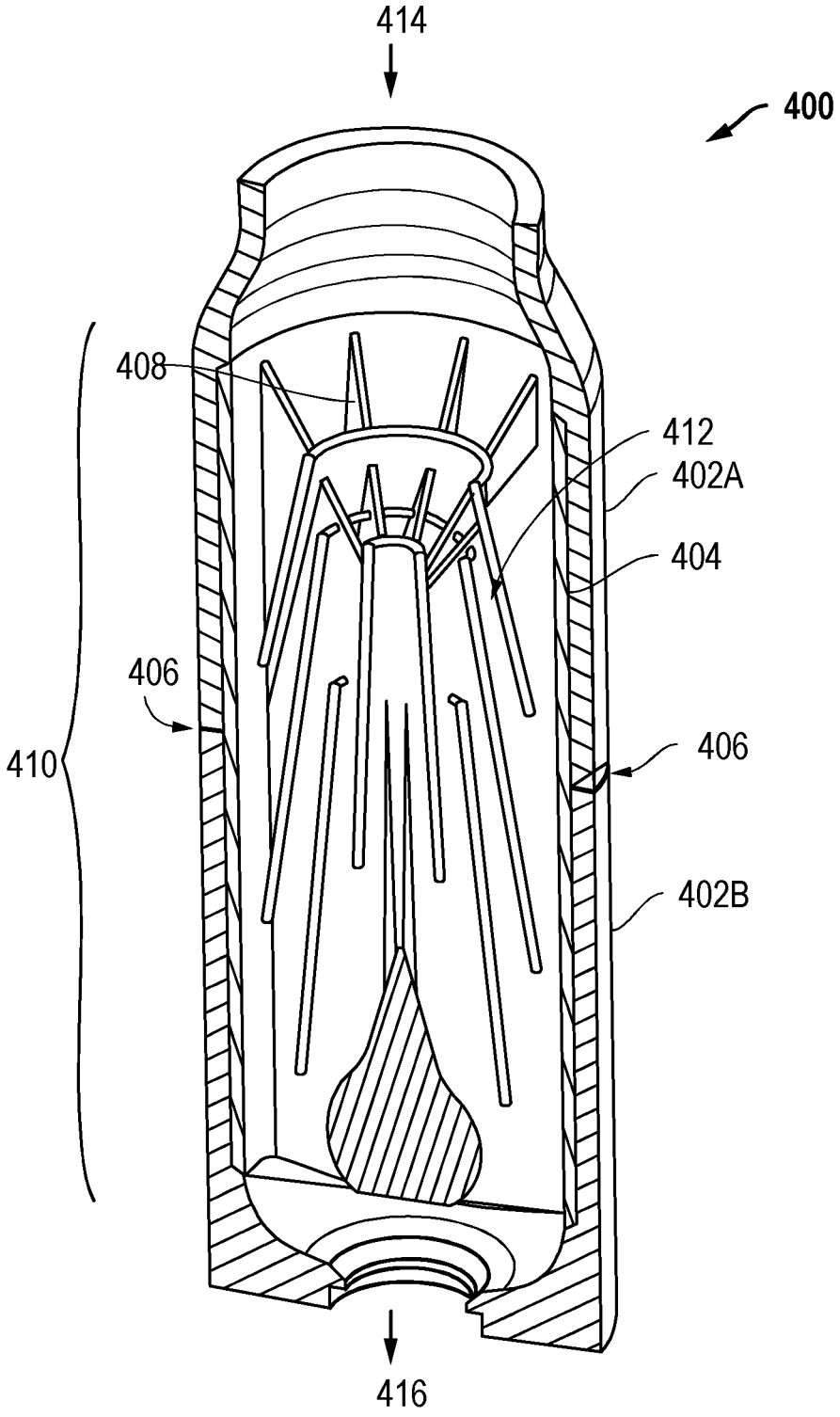
FIG. 4 is a diagram of an example embodiment where a vaporizer housing and chamber including a porous lattice structure have been encapsulated in a two-piece shell.

FIG. 4 is a diagram of an example embodiment 400 where a vaporizer housing 404 and chamber 412 have been encapsulated in a two-piece shell 402A/402B. For the example embodiment depicted, that vaporizer chamber 412 is a conical fin design, although other designs could also be used as described herein. The shell is a two-piece shell with a top portion 402A welded to a bottom portion 402B along a central seam 406. For example, the two shells pieces 402A/402B can be stainless steel pieces that are welded together. For one embodiment, an orbital weld along the middle seam 406 is used. Further, one or more welds can be used at other locations to melt the stainless steel shell through to the 3D-printed housing to ensure good thermal contact. For one implementation, four such locations are used where the shell is melted to the vaporizer core although it is understood that additional or different numbers of locations could also be used. Other variations could also be implemented while still taking advantage of the techniques described herein.

Figure 5:
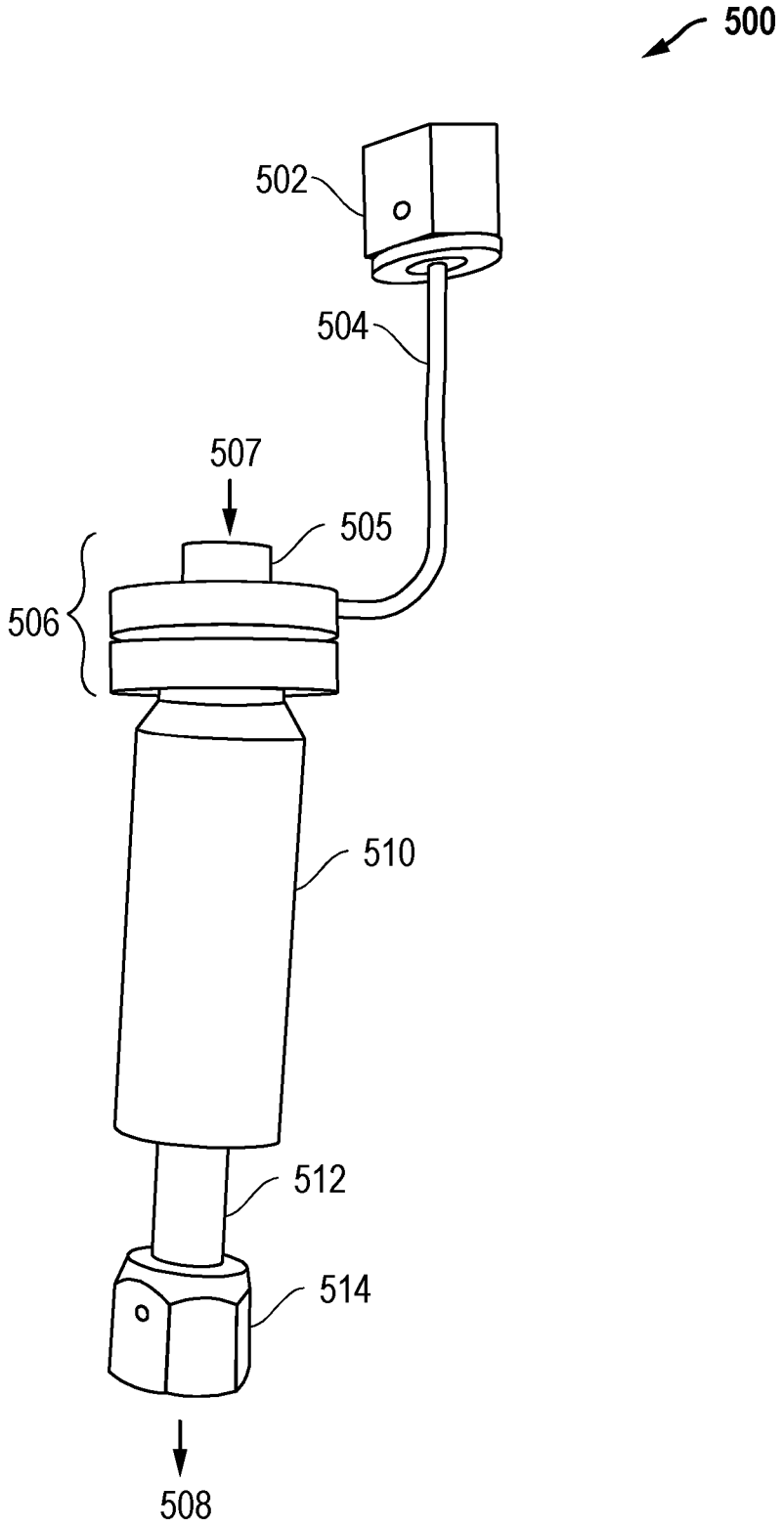
FIG. 5 is a diagram of an example embodiment for a reduced-size vaporizer that uses an improved vaporizer core according to one or more of the embodiments described herein.

FIG. 5 is a diagram of an example embodiment 500 for a reduced-size vaporizer that uses an improved vaporizer core 510 according to one or more of the embodiments described herein. This vaporizer operates in a similar way as described with respect to the vaporizer 100 in FIG. 1 (Prior Art) except that improved vaporizer core 510 is now used For this example embodiment, a carrier gas channel 504 receives a gas from source line 502 and provides it to a nozzle assembly 505. The nozzle assembly 505 will also receive a liquid solution to be vaporized as represented by arrow 507. The vaporizer core 510 is coupled to the nozzle assembly 505 using flanges 506. The liquid solution is vaporized in the vaporizer core 510 and is output to a process chamber or other processing equipment as indicated by arrow 508. For example, the vaporized liquid as well as the carrier gas can be output through a gas outlet channel 512 and an output gas line 514. Variations can be implemented while still taking advantage of the techniques described herein.

It is noted that reference throughout this specification to "one embodiment" or "an embodiment" means that a particular feature, structure, material, or characteristic described in connection with the embodiment is included in at least one embodiment of the invention, but do not denote that they are present in every embodiment. Thus, the appearances of the phrases "in one embodiment" or "in an embodiment" in various places throughout this specification are not necessarily referring to the same embodiment of the invention. Furthermore, the particular features, structures, materials, or characteristics may be combined in any suitable manner in one or more embodiments. Various additional layers and/or structures may be included and/or described features may be omitted in other embodiments.

"Microelectronic workpiece" as used herein generically refers to the object being processed in accordance with the invention. The microelectronic workpiece may include any material portion or structure of a device, particularly a semiconductor or other electronics device, and may, for example, be a base substrate structure, such as a semiconductor substrate or a layer on or overlying a base substrate structure such as a thin film. Thus, workpiece is not intended to be limited to any particular base structure, underlying layer or overlying layer, patterned or unpatterned, but rather, is contemplated to include any such layer or base structure, and any combination of layers and/or base structures. The description below may reference particular types of substrates, but this is for illustrative purposes only and not limitation.

Systems and methods for processing a microelectronic workpiece are described in various embodiments. One skilled in the relevant art will recognize that the various embodiments may be practiced without one or more of the specific details, or with other replacement and/or additional methods, materials, or components. In other instances, well-known structures, materials, or operations are not shown or described in detail to avoid obscuring aspects of various embodiments of the invention. Similarly, for purposes of explanation, specific numbers, materials, and configurations are set forth in order to provide a thorough understanding of the invention. Nevertheless, the invention may be practiced without specific details. Furthermore, it is understood that the various embodiments shown in the figures are illustrative representations and are not necessarily drawn to scale.

Further modifications and alternative embodiments of the described systems and methods will be apparent to those skilled in the art in view of this description. It will be recognized, therefore, that the described systems and methods are not limited by these example arrangements. It is to be understood that the forms of the systems and methods herein shown and described are to be taken as example embodiments. Various changes may be made in the implementations. Thus, although the inventions are described herein with reference to specific embodiments, various modifications and changes can be made without departing from the scope of the present inventions. Accordingly, the specification and figures are to be regarded in an illustrative rather than a restrictive sense, and such modifications are intended to be included within the scope of the present inventions. Further, any benefits, advantages, or solutions to problems that are described herein with regard to specific embodiments are not intended to be construed as a critical, required, or essential feature or element of any or all the claims.

What is claimed is:

1. A vaporizer core comprising;

a housing coupled to processing equipment for the manufacture of microelectronic workpieces; and a chamber within the housing, the chamber comprising a porous lattice structure that is thermally conductive and includes a plurality of fins, the chamber further comprising a first expanding cone shape to receive an atomized liquid and a second expanding cone shape to output a vaporized liquid;

wherein the housing and the chamber including the porous lattice structure are formed as a three-dimensional (3D) printed single piece integral structure to vaporize the atomized liquid.

2. The vaporizer core of claim 1, wherein the second expanding cone shape is smaller than the first expanding cone shape.

3. The vaporizer core of claim 2, further comprising a shell that is thermally conductive, wherein the housing and the chamber including the porous lattice structure are encapsulated in the shell.

4. The vaporizer core of claim 3, wherein the shell comprises a top portion and a bottom portion welded together along a central seam.

5. The vaporizer core of claim 4, wherein the shell is melted to the housing at a plurality of locations.

6. The vaporizer core of claim 1, wherein one or more of sintered metal, nano wires, metal fibers, or fibers made from a thermally conductive material are used to form the housing, the chamber, or both the housing and the chamber.

7. The vaporizer core of claim 1, wherein the housing and the chamber including the porous lattice structure are stainless steel.

8. The vaporizer core of claim 1, wherein the chamber comprises a first stage for the vaporizer core, and further comprising a second stage coupled to the first stage within the housing.

9. The vaporizer core of claim 8, wherein the housing and the chamber including the porous lattice structure are formed by three-dimensional (3D) printing, and wherein the second stage is not formed by 3D printing.

10. The vaporizer core of claim 1, wherein the plurality of fins are provided as at least one of a concentric-circle fin design, a crisscrossed fin design, or a conical fin design to form the porous lattice structure.

11. The vaporizer core of claim 10, wherein the plurality of fins are solid fins.

12. The vaporizer core of claim 1, wherein the chamber comprises a porous metal structure to form the porous lattice structure.

13. The vaporizer core of claim 12, wherein the porous metal structure comprises a metal foam or a metal fiber mesh.

14. The vaporizer core of claim 1, wherein surfaces of the housing and the chamber are polished.

15. A vaporizer coupled to processing equipment for the manufacture of microelectronic workpieces, the vaporizer comprising:

a nozzle assembly coupled to receive an atomized liquid comprising a liquid and a carrier gas;

a vaporizer core, comprising:

a housing coupled to the nozzle assembly to receive the liquid and the carrier gas; and a chamber within the housing, the chamber comprising a porous lattice structure that is thermally conductive, the porous lattice structure of the chamber having an expanding cone shape to vaporize the atomized liquid into a vaporized gas;

wherein the housing and the chamber including the porous lattice structure are formed as a single integral structure using a three-dimensional (3D) printing process; and a gas outlet channel coupled to processing equipment for the manufacture of microelectronic workpieces to provide the vaporized gas from the vaporizer core to the processing equipment.

16. The vaporizer of claim 15, wherein the expanding cone shape is a first coned shaped portion of the porous lattice structure, the porous lattice structure of the chamber having a second portion comprising an expanding cone shape smaller than the expanding cone shape of the first portion, the second portion provided between the first portion and the gas outlet.

17. The vaporizer of claim 16, wherein the vaporizer core further comprises a shell that is thermally conductive, and wherein the housing and the chamber including the porous lattice structure are encapsulated in the shell.

18. The vaporizer of claim 15, wherein the chamber comprises a plurality of fins including at least one of a concentric-circle fin design, a crisscrossed fin design, or a conical fin design to form the porous lattice structure.

* * * * *